US005123529A

United States Patent [19]

Hollingsworth

[11] Patent Number: 5,123,529

[45] Date of Patent: Jun. 23, 1992

[54] APPARATUS FOR MANUFACTURING METALLIC CARD CLOTHING

[76] Inventor: John D. Hollingsworth, Post Office Box 516, Greenville, S.C. 29602

[21] Appl. No.: 706,337

[22] Filed: May 28, 1991

Related U.S. Application Data

[62] Division of Ser. No. 551,296, Jul. 12, 1990, Pat. No. 5,096,506.

[51] Int. Cl.[5] ..... C21D 9/54

[52] U.S. Cl. ..... 266/103; 72/326

[58] Field of Search ..... 266/103; 76/112; 72/326

[56] References Cited

FOREIGN PATENT DOCUMENTS 0937084 6/1982 U.S.S.R. ..... 72/326

48701 1/1987 U.S.S.R. ..... 72/326

*Primary Examiner*—Deborah Yee

*Attorney, Agent, or Firm*—Bailey and Hardaway

[57] ABSTRACT

Metallic card clothing is illustrated having sharp metallic points C at tips of teeth 32 formed by punching and thereafter exerting a mechanical force bending metal over at the tips of the teeth.

9 Claims, 6 Drawing Sheets

Fig. 6.
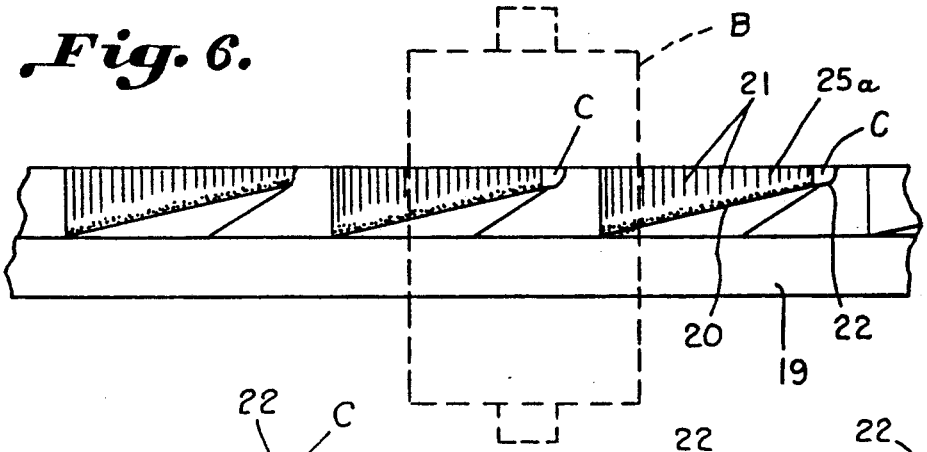
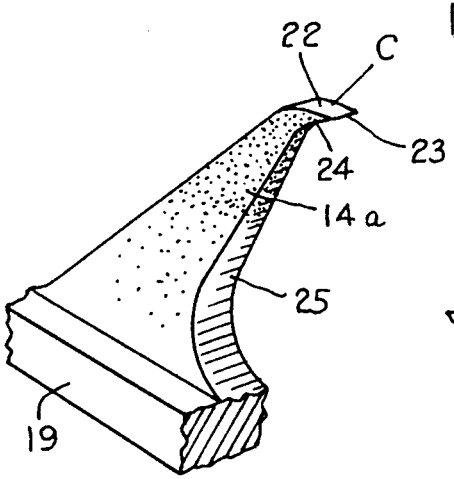
Fig. 7.
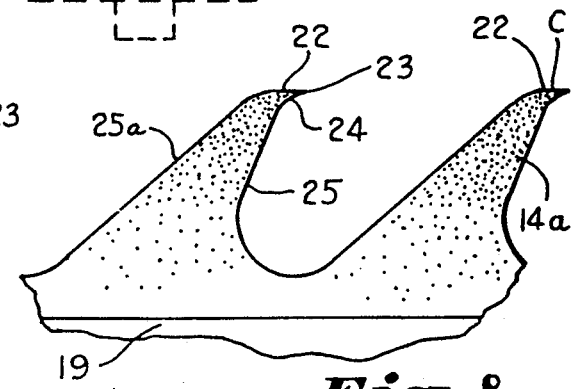
Fig. 8.
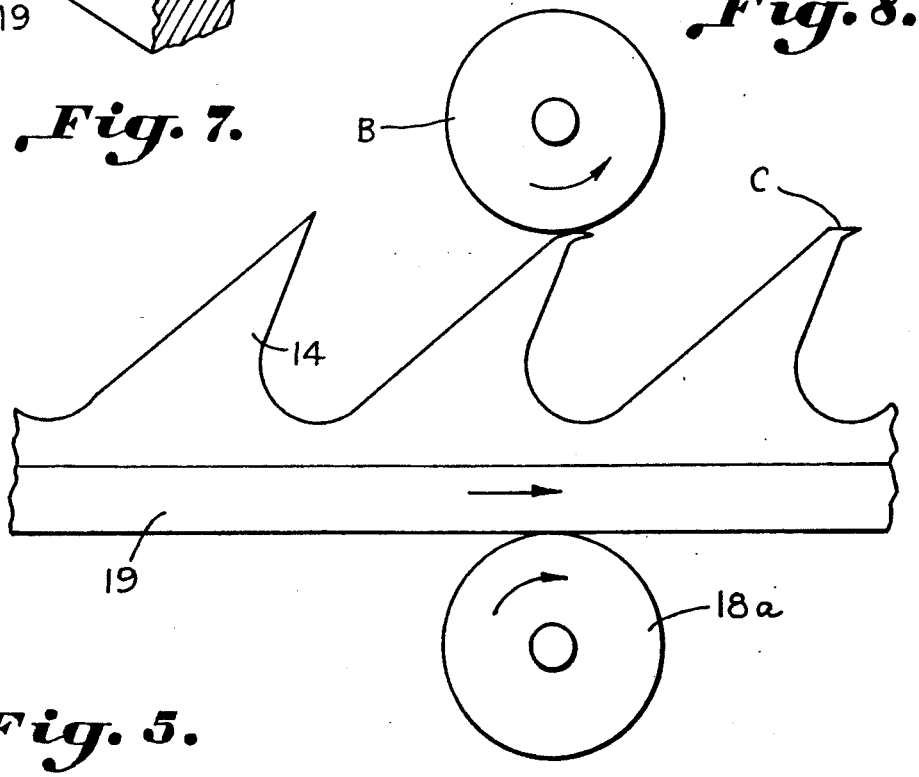
Fig. 5.

APPARATUS FOR MANUFACTURING METALLIC CARD CLOTHING

This application is a division of application Ser. No. 07/551,296, filed Jul. 12, 1990, now U.S. Pat. No. 5,096,506.

BACKGROUND OF THE INVENTION

Metallic card clothing having thin points as well as method and apparatus for manufacturing such card clothing is illustrated in U.S. Pat. Nos. 4,233,711, 4,453,431 and 4,537,096. Card clothing capable of improved carding action has resulted from the practice of the inventions of the above patents wherein a sharpened leading edge is provided during the punching operation forming the teeth of the metallic wire clothing. It is desirable to produce card clothing having advantages provided by the inventions of the above patents and yet avoid the necessity for a special punching operation. U.S. Pat. No. 4,428,209 is illustrative of flexible clothing having wires with bent tips. Such wires are embedded in and project from the usual cloth backing. The bending of the teeth occurs prior to insertion of the teeth into the cloth backing. Such flexible clothing is distinguishable from the metallic wire clothing of the present invention wherein metal at the tips of the punched teeth is mechanically bent over, as by force exerted against the tips toward the base of the metallic wire with consequent bending over, prior to or after hardening to form sharp points extending generally in the direction of carding.

An object of the invention is to improve carding so as to produce a clearer web resulting in high quality yarn especially utilizing blends of cotton and synthetic fibers. Synthetic fibers such as polyesters of fine denier have proved to be especially difficult to card when blended with cotton making metallic card clothing with thin or sharp pointed teeth especially desirable.

It is an important object of the present invention to provide novel metallic wire card clothing having the advantages of thin points through a novel method and apparatus.

Another important object of the invention is the provision of a novel method of producing improved metallic card clothing by mechanical bending of metal at the tips of teeth punched in the wire clothing.

Another important object of this invention is the provision of improved card clothing having sharp points formed by mechanical bending of metal at the tips of the teeth with hardening of the teeth forming hardened metallic carding surfaces at the tips of the teeth.

SUMMARY OF THE INVENTION

It has been found that points may be formed on the tips of the teeth punched in metal wire card clothing through the application of a mechanical force, preferably utilizing a roll, exerting a pressure against the teeth, bending metal at the tips of the respective teeth before or after hardening of the teeth without removing metal from the teeth. The ends of such teeth after hardening form carding surfaces which are augmented by the inclusion of points formed by the metal bent at the tips of the respective teeth generally in a direction of carding. Manipulation of the metal at the tips of the teeth as by bending or rolling or a combination thereof as illustrated in the drawings has been found to produce teeth having sharp points with improved carding. Wire having thin punched teeth such as disclosed in U.S. Pat. Nos. 4,233,711, 4,453,431 and 4,537,096 may be utilized in the practice of the present invention by inclusion of the bending of the tips forming points facing in the direction of carding.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 5 is an enlarged side elevation illustrating apparatus for bending the metal at the tips of the teeth;

FIG. 6 is a top plan view illustrating the points at the tips of the card clothing constructed in accordance with the present invention;

FIG. 7 is an enlarged perspective view illustrating teeth having points formed by bending of metal at the points prior to hardening;

FIG. 8 is an enlarged side elevation further illustrating teeth constructed in accordance with the invention;

DESCRIPTION OF A PREFERRED EMBODIMENT

The drawings of FIGS. 3–8 illustrate a method and apparatus for manufacturing novel metallic card clothing having sharp points from a strip of profile wire including subjecting a strip of wire to the action of a punch and die assembly A for punching teeth in the wire. The means as a rotatable roll B is provided for applying a mechanical force bending metal at the tips of respective teeth forming points C without removing metal. The ends of the teeth are subjected to the action of hardening means D forming hardened metallic carding surfaces at the ends of the teeth including the points and the tips of respective teeth. Thus, metallic card clothing providing improved carding action may be made by simple apparatus and method which may be readily utilized in production.

Figure 1:
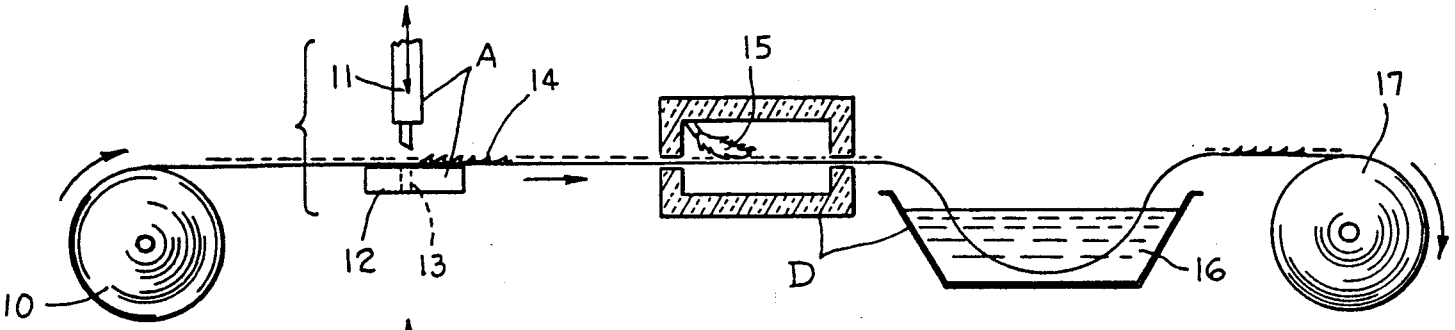
FIG. 1 is a schematic view illustrating the punching of teeth in a strip of metallic profile wire prior to hardening according to the prior art.

FIG. 1 illustrates a coil of conventional profile wire 10 from which the stock for the manufacturing of metallic wire card clothing is continuously fed to a punch and die assembly A which is illustrated as including a vertically reciprocating punch 11 and corresponding die 12 containing an opening 13. While a reciprocating punch is illustrated, a rotary punch or any other suitable punching apparatus may be utilized. The wire strand having teeth 14 formed therein, preferably at a positive angle and facing in the forward direction of passage of wire, as in carding, as illustrated by the arrow in FIG. 1, passes to the hardening process D. The hardening process may include flame treatment at 15 from whence the wire is illustrated as passing continuously through a quenching bath 16 preparatory to being wound continuously upon the takeup roll 17. Further, according to the prior art when, for example, the wire with hardened teeth formed therein passes from the roll 17 to be wound on a carding cylinder element the teeth will be preferably facing away from the direction of travel. Teeth which are thus hardened at their ends are brittle but possess desirable characteristics to engage and manipulate fibers during carding.

Figure 2:
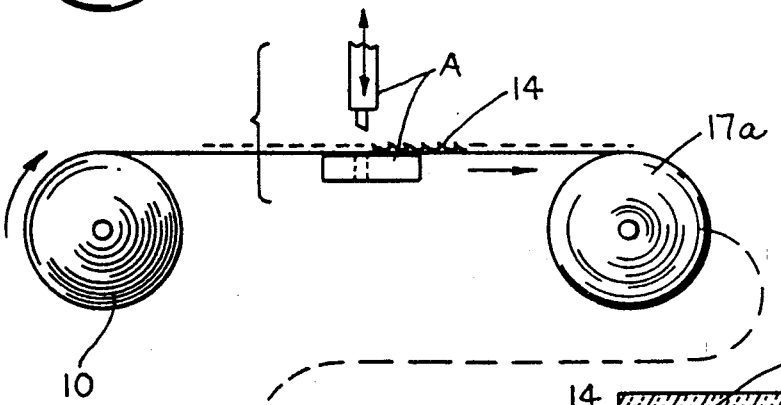
FIG. 2 is a schematic view illustrating an alternate form of manufacture of metallic card clothing utilizing separate punching and hardening operations in accordance with the prior art.
Figure 2:
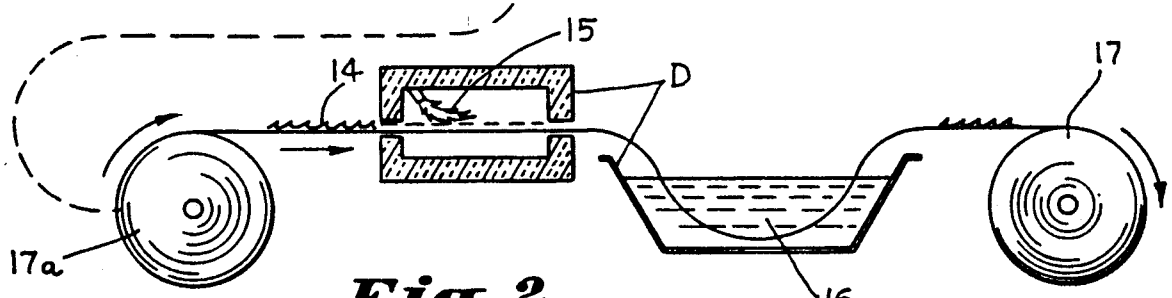

FIG. 2 further illustrates the prior art wherein a wire strip from a roll of profile wire is fed past the punch and die assembly illustrated at A and thence directly to a takeup roll 17*a*. The roll of wire 17*a* must then be processed further by passing the wire strip and the teeth formed therein to a hardening apparatus which is illustrated as including flame treatment 15 and bath 16 preparatory to being wound upon the takeup roll 17. It will be noted that the teeth 14 when passing from the punch and die assembly A are positioned at a positive angle facing in a direction opposite to the direction of travel, whereas when coming off the takeup roll 17*a*, the teeth 14 face in the direction of travel, as illustrated by the arrow, so that when unwinding the teeth from the roll 17 in FIG. 2 they will be facing in a direction opposite the direction of carding or opposed to the direction of travel of the wire when it is applied to a carding element such as a cylinder.

Figure 3:
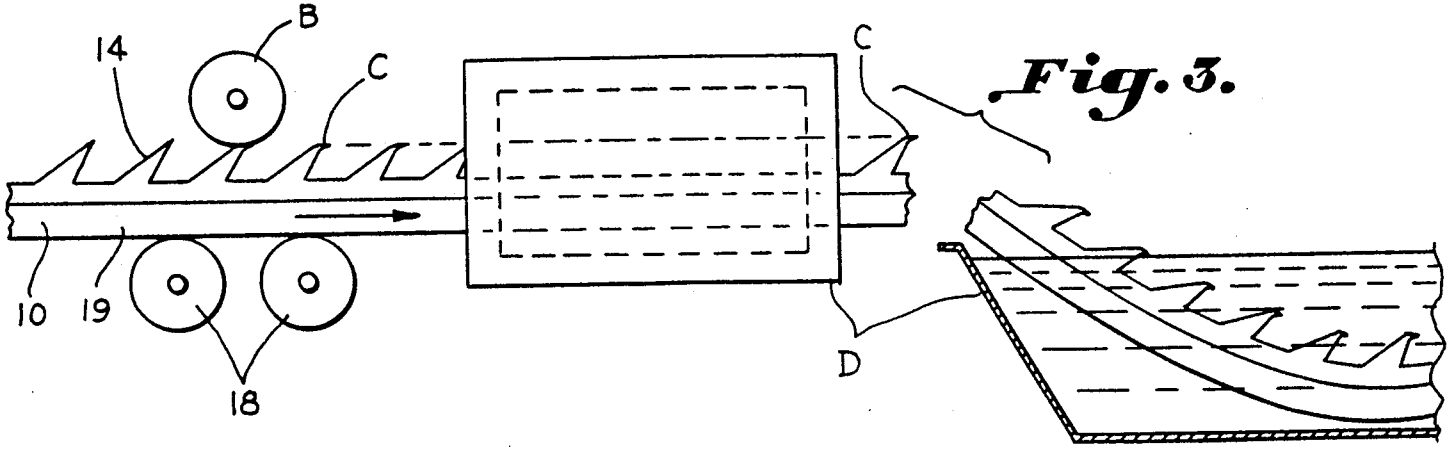
FIG. 3 is an enlarged side elevation illustrating the application of a mechanical force bending metal at the tips of the teeth forming points prior to hardening in accordance with the invention.

Referring now more particularly to FIG. 3, novel features of the invention are illustrated as including means such as a smooth rotatable roll B for applying a mechanical force bending down metal at the tips of respective teeth forming a point C without removing metal.

Figure 4:
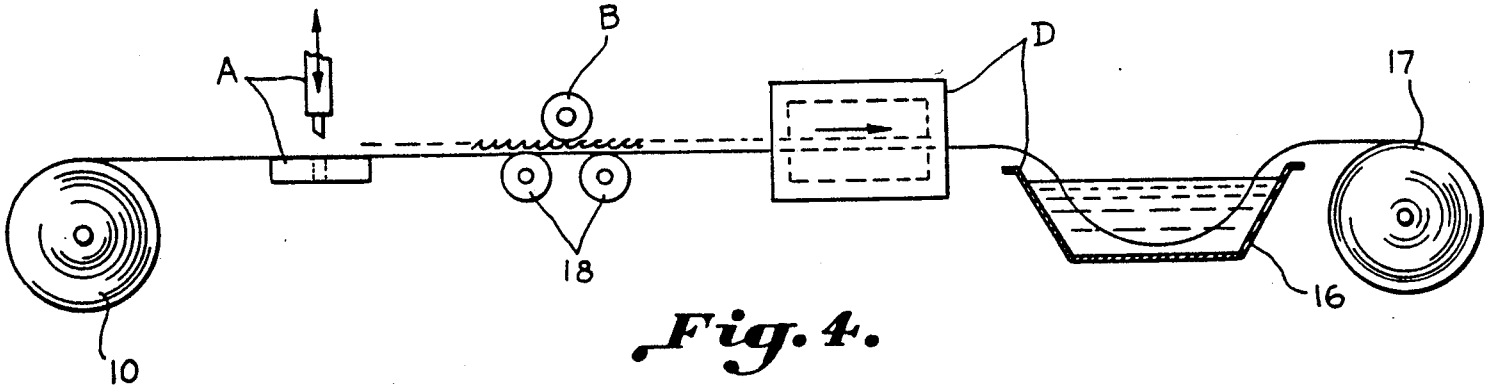
FIG. 4 is a schematic diagram illustrating the step shown in FIG. 3 in con]unction with the steps preceding and following such mechanical bending of the metal at the tips of the teeth forming points.

Referring to FIG. 4, a roll of profile wire illustrated at 10 and the apparatus for bending the metal at the tips of the teeth, without removing metal, is illustrated as being disposed between the punch and die assembly A and the hardening apparatus D past which the wire is continuously fed. The wire having been hardened by heating and quenching passes continuously from the quenching bath 16 to the takeup roll 17. Any suitable form of hardening apparatus may be utilized including the use of induction coils (not shown). The wire is illustrated as being supported by a pair of spaced rolls 18.

The roll B may be stationary, driven or it may simply by rotatable about a central axis as illustrated, or any other suitable mechanical apparatus may be utilized such as a bar or other mechanical mechanism for bending the metal at the tip to form the point C as illustrated in FIGS. 5–8. Support for the base of the strip is provided opposite the wire strip 10 by a backup roll 18*a* which is preferably directly opposite the roll B as shown in FIG. 5. Any suitable form of support mechanism may be employed including simply a base plate or suitable support for the shoulder 19 of the wire.

Referring more particularly to FIG. 5, a force applying means is illustrated as having bent over metal at the tips of the teeth 14 to form the sharpened forwardly facing points illustrated at C. The wire may have a shoulder as illustrated at 19, and the teeth include hardened ends at 14*a* (FIGS. 7 and 8) which illustrate the carding surfaces to which the hardening treatment has been applied and includes the tips and bent over metal. The metal is bent over to a desired degree as to an extent forming the substantially horizontal thin points C which may have relatively smooth upper surfaces where contacted by the roll. The metal at the top may then be flattened by the manipulation and bending thereof.

As is best seen in FIG. 6, trailing edges of the teeth are illustrated as including granulated areas 20 which represent the edges defining the entry of the punch into the metal of the teeth. The surface 21 contains shear lines substantially at right angles to the teeth. It has been found that the upper surface of the displaced metallic portions appears to be smooth and somewhat shiny in contrast to the leading and trailing edges of the teeth. The upper surfaces of the points C are illustrated at 22 while the leading flattened thin points are illustrated at 23. The sharp points C curve inwardly as at 24 into the leading edges 25 of the teeth. The leading edges 25 of the teeth are opposed to the trailing edges seen in FIG. 6 and designated 25*a*. The hardened end portions of the teeth are illustrated at 14*a* and are formed therein through the application of heat and the quenching step which may constitute a typical hardening operation, although other hardening procedures may be utilized. The leading edge 25 of the teeth also possess the granulated and sheared portions as described above resulting from punching of the teeth at the trailing edge.

It is thus seen that improved clothing is provided having teeth defined by a forwardly projecting sharp point facing generally in the direction of movement when on a carding element during carding. The tips may be bent over to any desired extent in the direction of carding and need not be horizontal as shown in the drawings. The entire ends of the teeth are hardened, passing through a transition zone down to the shoulder and in the present instance this includes the bent over metal forming the points at the tips of the teeth. It may be noted that the force may be applied by the roll B inwardly at substantially right angles to the shoulder and base thereon, and that unexpectedly the contact may be achieved between the roll and the teeth when the teeth are passing thereagainst facing in the direction of the arrow as they would be during a carding operation. It should be noted, however, that the step of bending metal at the tips of the teeth forming points may be carried out after punching and prior to take up as at 17*a* of FIG. 2 where the teeth face in a direction opposite to the direction of travel or such step may be carried out after takeup as at 17*a* and prior to hardening in FIG. 2 with the teeth facing in the direction of travel.

Figure 9:
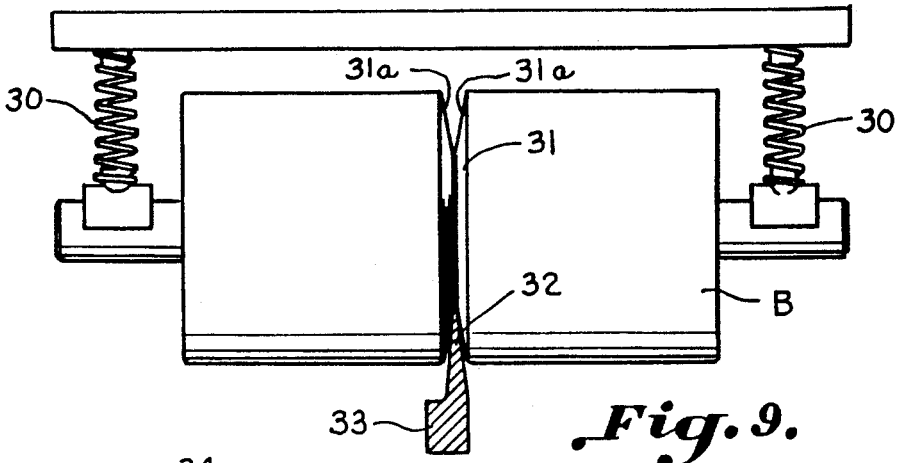
FIG. 9 is a side elevation illustrating a roll constructed in accordance with a modified form of the invention and means for exerting a compressive force through the roll against tops of the teeth.

FIG. 9 illustrates a method of weighing or otherwise urging the roll B or other force applying against the tips of the teeth of the metallic strip or card clothing which is provided with a support (not shown) of the type described above and illustrated as idler rolls 18 in FIG. 5 or otherwise provided with a substantial support. The roll B may be urged downwardly as by compression springs 30 at each end as illustrated.

FIGS. 9–13 illustrate modified forms of the invention. FIG. 9 illustrates the use of a single roll B wherein a V-shaped circumferential groove 31 has converging sides 31*a*. The teeth are illustrated at 32 and these project upwardly from the shoulder 33 into the groove. The teeth 32 may bottom out in the groove or the teeth may terminate at their tips, short of the bottom of the V-shaped groove 31 as illustrated in FIG. 9. In either instance the tooth has a flat portion at the tip and a point is formed by bent metal forming a thin edge converging at the sides coming somewhat more to a point than the tooth illustrated in FIG. 7. The action of the grooved roller is exemplary of manipulation of the metal at the tips of the teeth by a combination of compression or bending and rolling.

Figure 10:
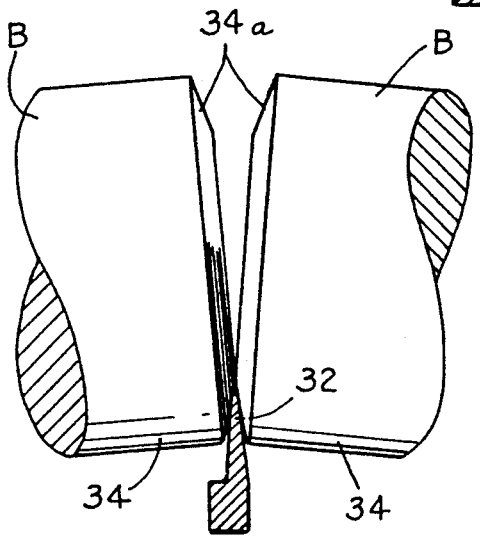
FIG. 10 is an enlarged side elevation illustrating still another modified form of the invention utilizing two aligned rolls with beveled edges.

FIG. 10 illustrates the use of a pair of rolls 34 having skewed axes and beveled faces 34*a* forming a V-shaped circumferential groove. The beveled faces engage the tips of the teeth 32 producing opposed inwardly directed components of compressive force as well as a downward force component.

Figure 11:
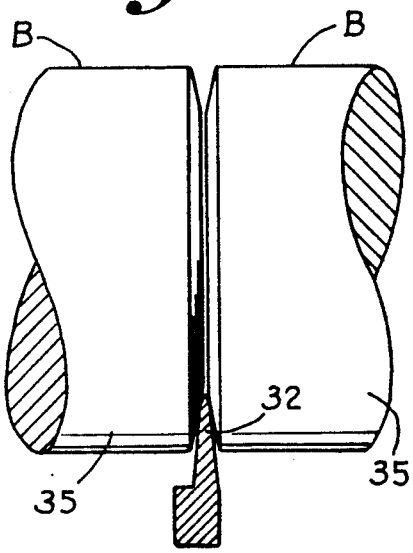
FIG. 11 is an enlarged side elevation illustrating still another modified form of the invention utilizing two aligned rolls with beveled edges.

FIG. 11 illustrates another modified form of the invention in which the axes are in alignment and wherein the rolls 35 are provided with a crown forming inwardly tapering surfaces 35*a* which converge to define a V-shaped groove for treating the tips of the teeth 32 prior to hardening as in the embodiments described above.

Figure 12:
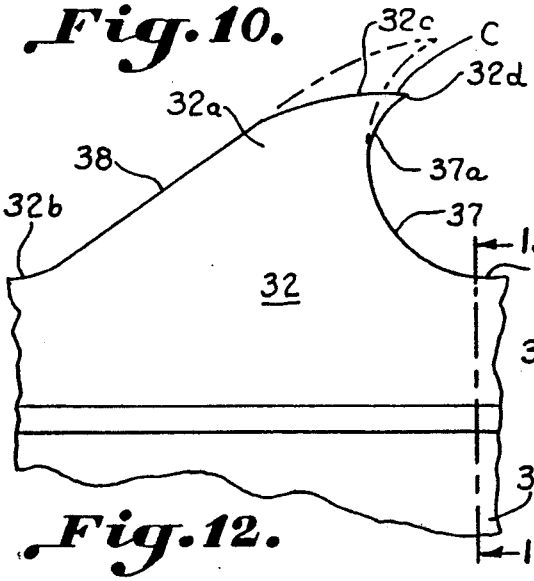
FIG. 12 is an enlarged side elevation further illustrating carding teeth constructed in accordance with the present invention utilizing the embodiment of FIG. 9.
Figure 13:
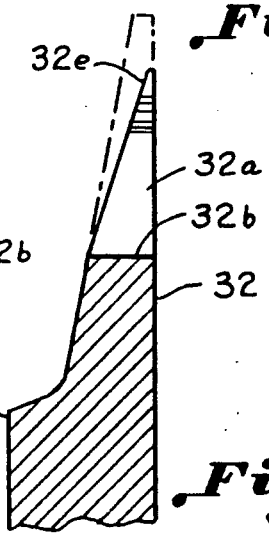
FIG. 13 is a transverse sectional elevation taken on the line 13—13 of FIG. 12.

FIGS. 12 and 13 illustrate a finished tooth constructed in accordance with the method of the present invention illustrating teeth formed by the modified forms of the apparatus of the invention illustrated in FIGS. 9–11. The particular tooth illustrated was made utilizing the embodiment of FIG. 9. The teeth 32 have tip portions 32*a* above the depth of cut 32*b*. A flattened top is illustrated at 32*c* which is bent into a point 32*d*. The teeth have a shoulder 33 and a leading edge 37 with trailing edges 38. The points 32*d* have a leading surface 37*a* which curves downwardly and inwardly into the surface 37. The teeth have points defined by inwardly tapering sides illustrated at 32*e* extending to the top 32*c* and curved surface 37*a*. The teeth after punching and before hardening are illustrated in broken lines in FIGS. 12 and 13.

It will be noted that the profile is lowered, after treatment resulting in a sharp point.

Figure 14:
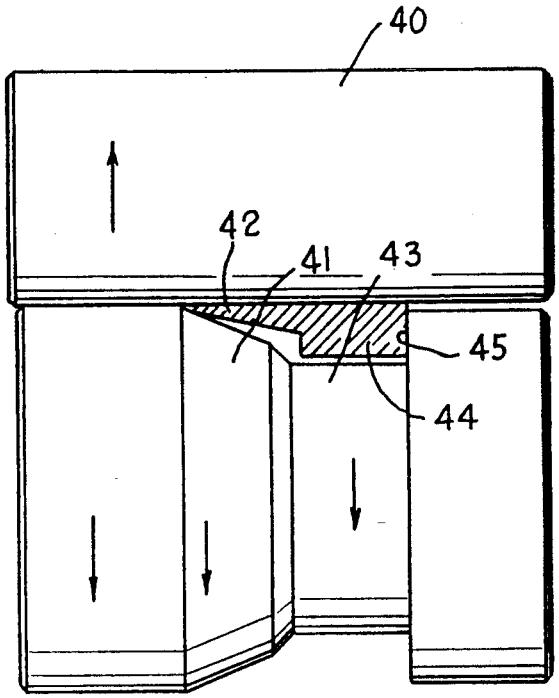
FIG. 14 is a side elevation illustrating apparatus for rolling the tips of the teeth utilizing parallel superposed rolls.
Figure 15:
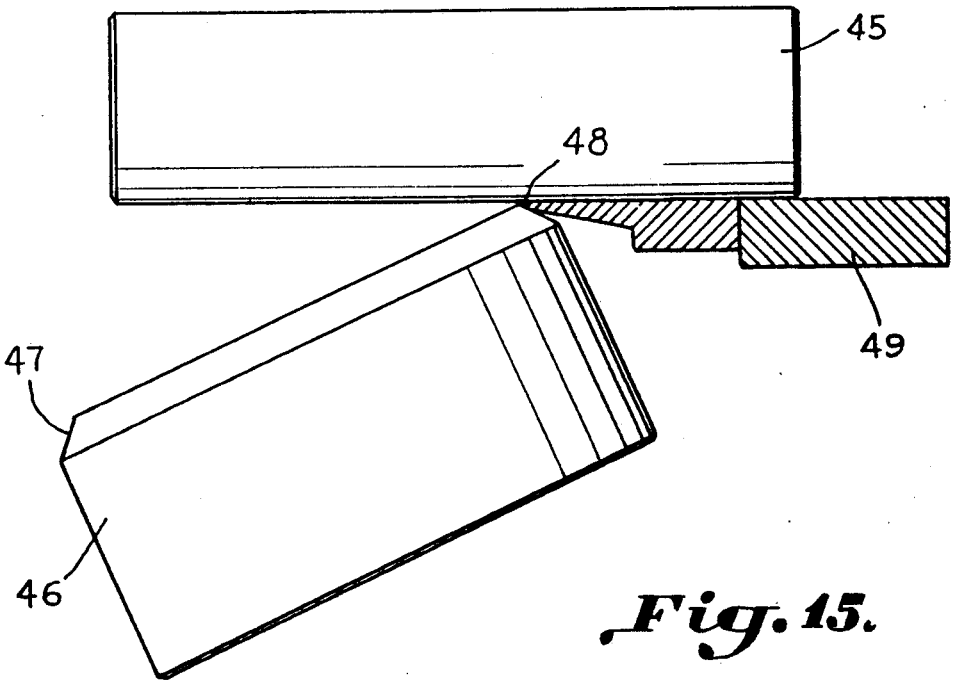
FIG. 15 is a side elevation illustrating apparatus for rolling the tips of the teeth utilizing a skewed roll having an axis extruding across a uniform roll.

Additional modified forms of apparatus are illustrated in FIGS. 14 and 15 and illustrate a rolling action at the tip of the teeth to bend metal providing thin points at least in part responsive to such rolling action. In FIG. 14, the axes of the superposed rolls are parallel. One of the rolls 40 is smooth and of uniform cross section while the other of the rolls has a tapered surface 41 for engaging the tip 42 of the teeth of the card clothing strip. A reduced portion 43 accommodates the shoulder 44 while a flat side 45 of the roll serves as a base for supporting a base of the shoulder 44.

FIG. 15 illustrates the use of a uniform roll 45 and a roll 46 skewed but extending across the roll 45. A beveled surface 47 engages the tip 48 of the teeth. A base is illustrated at 49.

Figure 16:
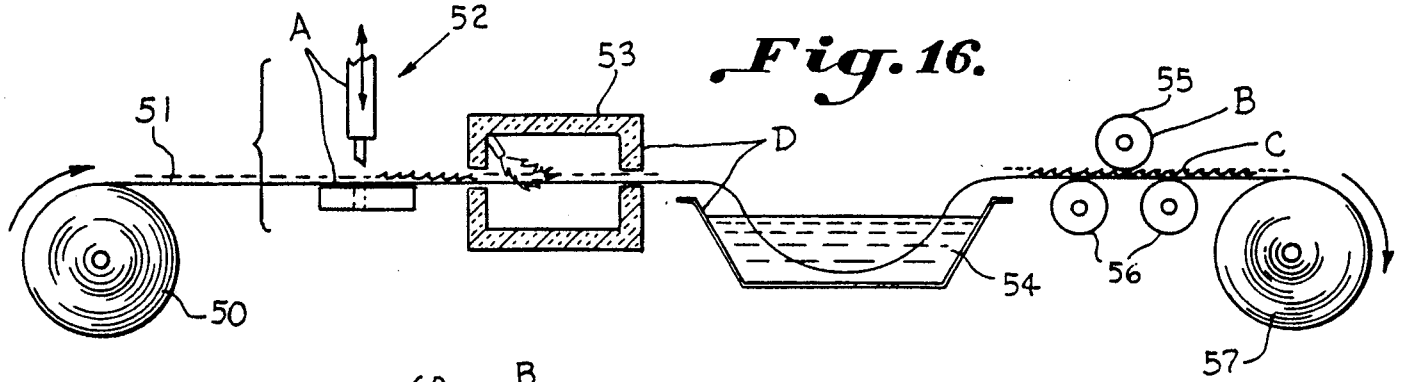
FIG. 16 is a schematic view illustrating an alternate form of the invention wherein the tips of the teeth of the metallic strip are bent after hardening.
Figure 18:
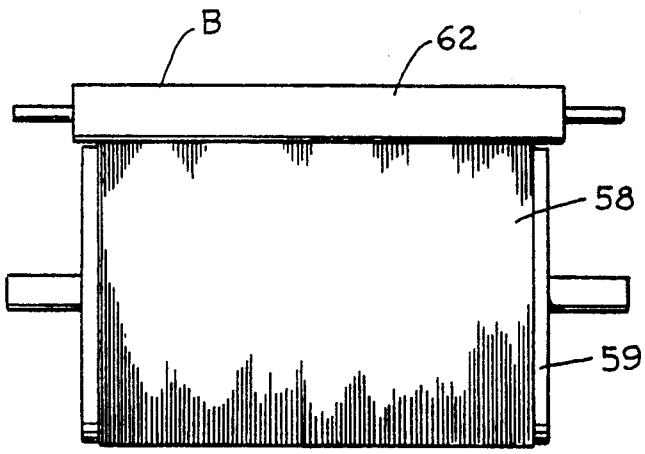
FIG. 18 is a front elevation illustrating apparatus for bending the tips across an entire roll on which wire clothing has been wound.
Figure 17:
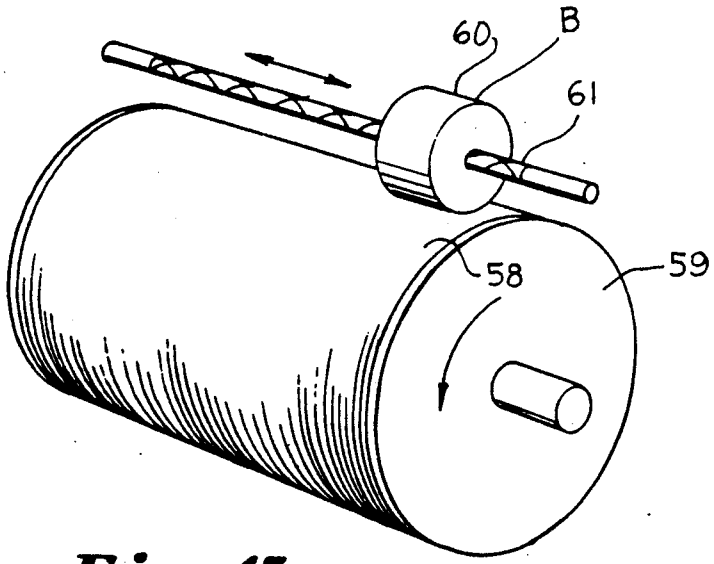
FIG. 17 is a perspective view illustrating a modified form of the invention wherein the teeth are bent while on a roll by a traversing roll mechanism.

FIGS. 16–18 illustrate a modified method and apparatus for manufacturing metallic card clothing from a strip of metallic wire. The strip of metallic wire, with the teeth facing in the direction of carding, is subjected to successive punching operations forming teeth in said strip of metallic wire projecting from a base. The strip of metallic wire is supported with teeth having tips projecting outwardly from tree ends thereof. A roll is mechanically pressed against the tips bending a portion of the tips at least partially over in a direction of carding providing metallic card clothing having teeth with sharp points facing in a carding direction affording enhanced carding action with fewer neps. The method preferably includes bending the tips by a mechanical pressing action without removing metal. The base is preferably carried upon a fixed support while mechanically pressing against the tips. The wire is preferably continuously moved during punching and while mechanically pressing against the tips.

FIG. 16 illustrates a roll of profile wire 50 wherein a strip of metal wire 51 is subjected to the action of a punch broadly designed at 52 of a punch and die assembly A and is moved in the direction of the arrow continuously through hardening apparatus D which may include heating apparatus 53 and a quenching bath 54. The tips of the teeth are subjected to a compressive action of a mechanical mechanism B such as a roll 55 while suitably supported as by rolls 56 forming points C, facing in the direction of carding, prior to being taken up on a roll 57.

FIG. 17 illustrates another alternate form of the invention wherein the card clothing is wound upon a roll as illustrated at 58 and is supported upon a main cylinder as illustrated at 59 in such embodiment. A relatively narrow roll 60 is illustrated as being carried by the usual traversing mechanism 61 as upon a traverse grinder, but in this instance the roll 60 provides a compressive force against the teeth of the supported wire so as to bend over the tips as previously illustrated herein.

FIG. 18 illustrates another modified form of the invention wherein the metallic clothing 58 wound upon the cylinder 59 is subjected to the action of a roll 62 which bends down the teeth and further accomplishes a leveling action in that the teeth all across the roll constituted by the main cylinder 59 will be of the same height.

In addition to cylinders, the metallic clothing may be applied to other carding or combing elements and the like including carding rolls, revolving or stationary card flats, stationary carding plates and comber half laps prior to bending the tips of the teeth. The teeth may be bent, in a direction of carding, to form thin points in any desirable way as discussed above. Other ways of bending may be utilized as by pressing the teeth of the carding element against flat or curved surfaces or by any other bending apparatus for bending the tips to form points.

It has been found preferably to bend over the teeth about 0.003 and not over 0.005 inches. Preferably the teeth illustrated in FIGS. 16–18 have been hardened but not in excess of a Rockwell C Scale hardness of approximately 57 or 58. Such hardness is less than that conventionally imparted to the metallic wire clothing but is not so great as to result in excessive breaking off of the teeth during bending of the tips due to brittleness. The range of hardness varies and is difficult to measure. The hardness is greatest at the tip ends of the teeth and varies downwardly of the teeth toward the depth of cut portion of the teeth where they join the base. The point at which bending occurs is preferably about 0.003 inches. The tips of the teeth are bent to provide points as distinguished from grinding and the invention is preferably carried out without grinding or other action as would remove metal from the teeth.

It has been found that a profile wire having lower than usual carbon content may be utilized to facilitate the formation of the sharpened or thin points. Reduced useful life of the card clothing is justified by the improved carding action achieved. It has been found possible to manufacture such teeth on a routine basis without adding excessively to the complexity of the punching or hardening operations or resorting to operations such as side grinding or efforts to roll a thinner edge in the profile wire prior to punching.

The present practice of grinding metallic clothing causes metal at the tips of the teeth to smear out as a small beard or burr on the leading edge of the point. This burr improves the carding characteristics of the metallic clothing by lowering the nep count among other improvements in carding performance. The very fragile beard or burr has the disadvantage of being very frail and, therefore, it wears off and loses its effectiveness under high speed carding conditions in a relatively short time.

By contrast, this invention contemplates bending of the tips of the teeth with less or no grinding so as to provide bent over points consisting of substantial amounts of metal facing generally in the direction of carding. Such points provide longer life than the beard or burr as results from grinding under high speed carding conditions.

By bending the tips with less or no grinding and with more rolling of the point, the shape and extent of forward protrusion of the point can be more readily controlled so that the maximum amount of metal provides a sharp point thereby giving the best possible performance characteristics and longest possible life consistent therewith. It is believed to be possible to grind card clothing manufactured in accordance with the present invention when such is necessitated by use.

The practice of the present invention is contrary to the teachings of the prior art which, except for grinding practices, normally cautions against allowing anything to hit the tips of the teeth of metallic card clothing.

While a preferred embodiment of the invention has been described using such specific terms, such description is for illustrative purposes only, and it is to be understood that changes and variations may be made without departing from the spirit or scope of the following claims.

What is claimed is:

1. Apparatus for manufacturing metallic card clothing from a strip of profile wire comprising:

a punch for forming a plurality of longitudinally aligned teeth in said wire;

mechanical means opposite said teeth exerting an inward force against the tips of said teeth bending over metal forming forwardly projecting points;

support means carrying said strip on a base portion of said strip opposite said teeth for continuous movement; and means hardening end portions of said teeth which include said tips and said points forming hardened carding surfaces.

2. The structure set forth in claim 1 wherein said mechanical means includes a rotatably mounted roller means.

3. The structure set forth in claim 2 wherein said roller means is a single smooth roller.

4. The structure set forth in claim 2 wherein said roller means is a single roller having a circumferential groove with inwardly tapering sides engaging tips of said teeth.

5. The structure set forth in claim 2 wherein said roller means includes a pair of rollers having opposed skewed axes with inwardly tapering opposed surfaces at adjacent ends of said rolls forming a circumferential groove engaging the tips of said teeth.

6. The structure set forth in claim 2 wherein said roller means includes a pair of rollers having aligned axes and opposed surfaces at adjacent ends of said rolls forming a circumferential groove engaging the tips of said teeth.

7. The structure set forth in claim 2 wherein said roller means are forcefully urged against said teeth.

8. The structure set forth in claim 2 wherein superposed rollers include a tapered surface.

9. The structure set forth in claim 2 wherein a roll has a beveled end extending across a uniform roll for rolling tips of the teeth.

* * * * *